US009756416B2

(12) United States Patent
Shao et al.

(10) Patent No.: US 9,756,416 B2
(45) Date of Patent: Sep. 5, 2017

(54) LOUDSPEAKER MODULE

(71) Applicant: GOERTEK INC., Shandong (CN)

(72) Inventors: Minghui Shao, Shandong (CN); Zhibing Zhang, Shandong (CN); Gang Chen, Shandong (CN); Jianbin Yang, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 15/037,072

(22) PCT Filed: Apr. 29, 2014

(86) PCT No.: PCT/CN2014/076431
§ 371 (c)(1),
(2) Date: May 17, 2016

(87) PCT Pub. No.: WO2015/070573
PCT Pub. Date: May 21, 2015

(65) Prior Publication Data

US 2016/0295316 A1 Oct. 6, 2016

(30) Foreign Application Priority Data

Nov. 18, 2013 (CN) ..... 2013 1 0578976

(51) Int. Cl.
*H04R 1/28* (2006.01)
*H04R 1/02* (2006.01)

(52) U.S. Cl.
CPC ..... *H04R 1/2888* (2013.01); *H04R 1/025* (2013.01); *H04R 1/2826* (2013.01); *H04R 1/2857* (2013.01); *H04R 1/021* (2013.01)

(58) Field of Classification Search
CPC ..... H04R 1/021; H04R 1/025; H04R 1/2819; H04R 1/2857; H04R 9/06; H04R 2499/11
See application file for complete search history.

(56) References Cited

FOREIGN PATENT DOCUMENTS

CN 2410836 A 12/2000
CN 201219304 Y 4/2009
(Continued)

OTHER PUBLICATIONS

Office Action issued by the State IP Office of the People's Republic of China, in corresponding Application No. 201310578976.2, dated Mar. 28, 2016.

*Primary Examiner* — Matthew Eason
(74) *Attorney, Agent, or Firm* — Holzer Patel Drennan

(57) ABSTRACT

Disclosed is a loudspeaker module, which comprises a loudspeaker unit and a peripheral frame comprising an upper housing and a lower housing; a front acoustic cavity and a rear acoustic cavity are respectively defined as a space between the loudspeaker unit and the upper housing, and a space between the loudspeaker unit and the lower housing; a sound hole in communication with the front acoustic cavity is provided on peripheral frame, and an inverted tube is provided in peripheral frame. The loudspeaker module of the present invention is provided with inverted tube in communication with rear acoustic cavity, so that low-frequency acoustic effect of products can be enhanced, and heat dissipation of rear acoustic cavity and balance of atmospheric pressures can be achieved; inverted tube and loudspeaker unit share front acoustic cavity and sound hole, which is beneficial to increasing size of loudspeaker unit and improving acoustic performance of products.

7 Claims, 6 Drawing Sheets

(56) References Cited

FOREIGN PATENT DOCUMENTS

| | | | | | |
|---|---|---|---|---|---|
| CN | 201928421 | U | | 8/2011 | |
| CN | 202183845 | U | | 4/2012 | |
| CN | 202385272 | U | | 8/2012 | |
| CN | 203125876 | U | | 8/2013 | |
| CN | 203193837 | U | * | 9/2013 | ..... H04R 1/10 |
| CN | 103686550 | A | | 3/2014 | |
| CN | 203708464 | U | | 7/2014 | |

* cited by examiner

LOUDSPEAKER MODULE

CROSS-REFERENCE TO RELATED APPLICATIONS

The present application claims benefit of priority to PCT Application No. PCT/CN2014/076431, entitled "LOUDSPEAKER MODULE" and filed on 29 Apr. 2014, which is specifically incorporated by reference herein for all that it discloses or teaches. The present application claims further benefit of priority to Chinese Application No. 201310578976.2, which was filed 18 Nov. 2013 and is also specifically incorporated by reference herein for all that it discloses or teaches.

TECHNICAL FIELD

The present invention relates to the technical field of electro-acoustic products, specifically, to a loudspeaker module.

BACKGROUND

In prior art, a loudspeaker module comprises a loudspeaker unit and a peripheral frame accommodating and fixing the loudspeaker unit, wherein, a front acoustic cavity and a rear acoustic cavity are respectively formed between the loudspeaker unit and the peripheral frame, and the front acoustic cavity and the rear acoustic cavity are spaced apart from each other, the front acoustic cavity is in communication with a sound hole of the loudspeaker module, the rear acoustic cavity is a sealed structure. The peripheral frame of the loudspeaker module with conventional structure is generally provided with a leaking hole, which has a small bore diameter and communicates the rear acoustic cavity and outside, and the leaking hole is used for dissipating heat and balancing sound pressure. However, as a large amount of heat is generated during the operation of the loudspeaker unit, the leaking hole with small bore diameter can not completely dissipate the heat generated by the loudspeaker unit, which affects the useful life of the loudspeaker module.

At present, the low-frequency acoustic effect of the loudspeaker module needs to be improved, while the bass effect of the loudspeaker module is mainly controlled by the volume of the rear acoustic cavity. When the rear acoustic cavity has a larger volume, the loudspeaker module has a better bass effect. However, the existing electronic products are gradually thinned and miniaturized, and the size of the loudspeaker module is limited. Thus, it is impossible to extend the low frequency of the product by increasing the volume of the rear acoustic cavity thereof.

In addition, in a large-sized sound box with conventional structure, an inverted tube is provided to improve the bass effect of the sound box. However, in the sound box with such a structure, a sound hole, which is used for communicating the inverted tube and outside, and a sound hole of the sound box are arranged separately. Since the size of the loudspeaker module is limited, it is difficult to apply such an inverted tube structure, which is applied in the sound box, in the loudspeaker module directly, and excessive space will be occupied if the inverted tube and the loudspeaker unit are provided with sound holes respectively, which will decrease the size of the loudspeaker unit.

Thus, there is a demand for improving the loudspeaker module with such a structure to eliminate the above defects.

SUMMARY

The technical problem to be solved by the present invention is to provide a loudspeaker module capable of dissipating heat effectively, extending low frequency of the product effectively, as well as saving the internal space of the loudspeaker module while the position and size of the sound hole of the loudspeaker module are fixed, which is favorable for the increase of the size of the loudspeaker unit.

In order to solve the above technical problem, the technical solution of the present invention is that: a loudspeaker module, comprising a loudspeaker unit and a peripheral frame accommodating and fixing the loudspeaker unit, wherein the peripheral frame comprises an upper housing and a lower housing, a front acoustic cavity is defined as a space between the loudspeaker unit and the upper housing, and a rear acoustic cavity is defined as a space between the loudspeaker unit and the lower housing; a sound hole in communication with the front acoustic cavity is provided on the peripheral frame, wherein, acoustic waves radiated by a vibrating diaphragm of the loudspeaker unit to the front acoustic cavity are radiated to outside through the front acoustic cavity and the sound hole; and an inverted tube is further provided in the peripheral frame, wherein, one end of the inverted tube is in communication with the rear acoustic cavity, other end of the inverted tube is in communication with the front acoustic cavity, and acoustic waves radiated by the vibrating diaphragm of the loudspeaker unit to the rear acoustic cavity are radiated to the outside from the sound hole after passing through the inverted tube and the front acoustic cavity.

In addition, it is preferred that, the peripheral frame further comprises a middle housing combined between the upper housing and the lower housing; the middle housing comprises an outer lateral wall combined with the upper housing and the lower housing, an inner lateral wall provided in the middle housing, and a partition wall provided at the bottom of the inner lateral wall; the inner lateral wall together with the outer lateral wall forms a channel for transmitting acoustic waves; one end of the channel is in communication with the rear acoustic cavity, and other end of the channel extends to the front acoustic cavity; wherein, the inner lateral wall, the partition wall, and the outer lateral wall of the middle housing together with the upper housing form the inverted tube.

In addition, it is preferred that, the upper housing is provided with a sealing rib, which protrudes from a lower surface of the upper housing, at a position facing the inner lateral wall of the middle housing; a top end of the inner lateral wall of the middle housing is provided with an accommodating groove, which is formed by removing material, at a position facing the sealing rib, wherein, the sealing rib is snap-fitted into the accommodating groove, and the sealing rib is fixedly combined with the accommodating groove by gluing.

In addition, it is preferred that, the sealing rib is a welded rib, and the sealing rib is fixedly combined with the inner lateral wall of the middle housing by welding.

In addition, it is preferred that, the loudspeaker unit has a rectangular shape, four corners of bottom of the loudspeaker unit are provided with sound outlet holes, the lower housing is provided with a supporting part at a position opposite to the center of the bottom of the loudspeaker unit, and the supporting part has a cruciform shape, so as to prevent the sound outlet holes at the bottom of the loudspeaker unit from being blocked by the lower housing.

In addition, it is preferred that, the loudspeaker unit together with the partition wall of the middle housing, the outer lateral wall of the middle housing and the lower housing forms the rear acoustic cavity; an open end penetrating through the middle housing is provided at a central position of the inner lateral wall, wherein, the open end is an opening for communicating the inverted tube with the rear acoustic cavity, and the acoustic waves in the rear acoustic cavity enter into the inverted tube through the open end.

In addition, it is preferred that, the middle housing comprises a fixing part for accommodating and fixing the loudspeaker unit; and the loudspeaker unit together with the upper housing and the middle housing forms the front acoustic cavity of the loudspeaker module.

In addition, it is preferred that, the ratio of the resonant frequency of the rear acoustic cavity and the inverted tube to that of the loudspeaker unit ranges from ⅓ to 1.4

By adopting the above technical solution, compared with conventional structures, the loudspeaker module of the present invention is provided with the inverted tube which is in communication with the rear acoustic cavity, so that the low-frequency acoustic effect of a product can be improved significantly, and the bass effect of the loudspeaker module can be improved; as the inverted tube is in communication with the rear acoustic cavity and outside, in the loudspeaker module of the present invention, the heat dissipation of the rear acoustic cavity and the balance of atmospheric pressures can be achieved through the inverted tube; and furthermore, as the inverted tube and the loudspeaker unit share the front acoustic cavity and the sound hole, the internal space of the loudspeaker module can be saved, which is beneficial to increasing the size of the loudspeaker unit, thereby being beneficial to improving the acoustic performance of the product.

BRIEF DESCRIPTIONS OF THE DRAWINGS

The above features and technical advantages of the present invention will become more clear and easy to understand through the descriptions of the present invention in connection with the accompanying drawings below.

DETAILED DESCRIPTIONS

Hereinafter, the present invention is described in details in connection with the accompanying drawings and particular embodiments.

As shown in FIG. 1 to FIG. 6, a loudspeaker module comprises a loudspeaker unit 2 and a peripheral frame accommodating and fixing the loudspeaker unit 2, wherein the peripheral frame comprises an upper housing 11 and a lower housing 13, a front acoustic cavity is defined as a space between the loudspeaker unit 2 and the upper housing 11, and a rear acoustic cavity is defined as a space between the loudspeaker unit 2 and the lower housing 13; a sound hole 10 in communication with the front acoustic cavity is provided on the peripheral frame. And acoustic waves radiated by a vibrating diaphragm of the loudspeaker unit 2 to the front acoustic cavity are radiated to the outside through the front acoustic cavity and the sound hole 10. An inverted tube is further provided in the peripheral frame, wherein, one end of the inverted tube is in communication with the rear acoustic cavity, the other end of the inverted tube is in communication with the front acoustic cavity, and acoustic waves radiated by the vibrating diaphragm of the loudspeaker unit 2 to the rear acoustic cavity are radiated to the outside from the sound hole 10 after passing through the inverted tube and the front acoustic cavity, thereby extending low frequency of the loudspeaker module and improving the bass effect of the loudspeaker module.

Figure 4:
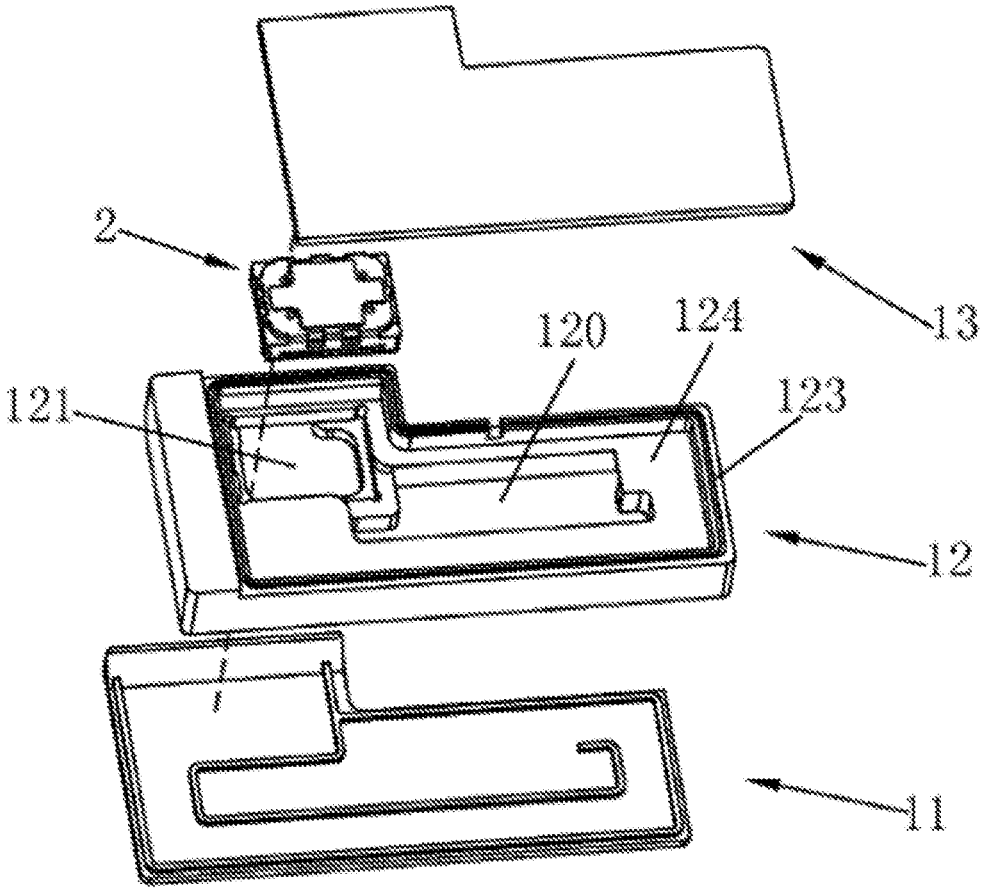
FIG. 4 is a three-dimensional structure view 2 of the loudspeaker module according to the present invention.

Preferably, the peripheral frame of the present embodiment further comprises a middle housing 12 combined between the upper housing 11 and the lower housing 13; the front acoustic cavity of the present embodiment is formed by the upper housing 11, the middle housing 12 and the loudspeaker unit 2 jointly, and the rear acoustic cavity is formed by the lower housing 13, the middle housing 12 and the loudspeaker unit 2 jointly. The loudspeaker unit 2 is not shown in details, and the loudspeaker unit 2 comprises a vibration system and a magnetic circuit system, wherein, the vibration system comprises a vibrating diaphragm and a voice coil bonded to one side of the vibrating diaphragm, the magnetic circuit system comprises a washer, a magnet and a frame that are sequentially combined together, and the magnetic circuit system forms a magnetic gap for accommodating the voice coil; the voice coil is subjected to force and vibrates up and down in the magnetic field generated by the magnetic circuit system after electric signal is turned on, and drives the vibrating diaphragm to vibrate to generate sound. Preferably, as shown in FIG. 1 and FIG. 4, the middle housing 12 of the loudspeaker module comprises a fixing part 121 for accommodating and fixing the loudspeaker unit 2, and the fixing part 121 is used for fixing the loudspeaker unit 2 and separating the acoustic waves generated from the front side and rear side of the vibrating diaphragm of the loudspeaker unit 2 completely.

Preferably, an outer lateral wall 123 is provided at the periphery of the middle housing 12, and the outer lateral wall 123 is fixedly combined with the upper housing 11 and the lower housing 12 to protect the internal structure of the loudspeaker module; an inner lateral wall 122 is provided in the middle housing 12, and the inner lateral wall 122 together with the outer lateral wall 123 forms a channel (preferably, the channel has a heliciform shape) for transmitting acoustic waves, one end of the channel is in communication with the rear acoustic cavity, and other end of the channel extends to the front acoustic cavity; a partition wall 124 is further provided at the bottom of the inner lateral wall 122, and the partition wall 124 may be so provided as to be perpendicular to the inner lateral wall 122, and the inner diameter of the inverted tube can be adjusted by adjusting the position of the partition wall in vertical direction. In addition, preferably, an open end 120 penetrating through the middle housing 12 is provided at the inner side of the inner lateral wall 122, i.e., the open end 120 is an opening formed in the partition wall 124. As shown in FIG. 4, the open end 120 is an opening for communicating the inverted tube with the rear acoustic cavity.

Figure 1:
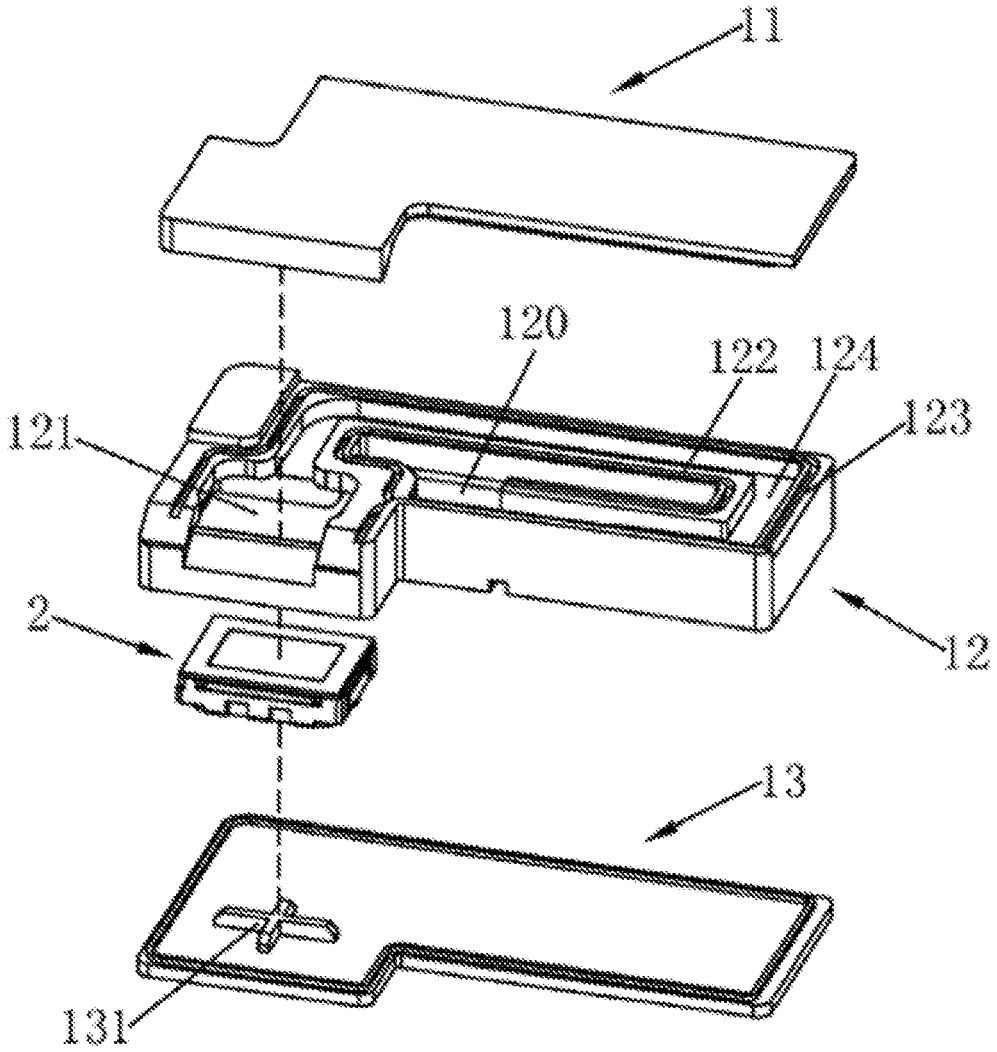
FIG. 1 is a three-dimensional structure exploded view 1 of the loudspeaker module according to the present invention.
Figure 6:
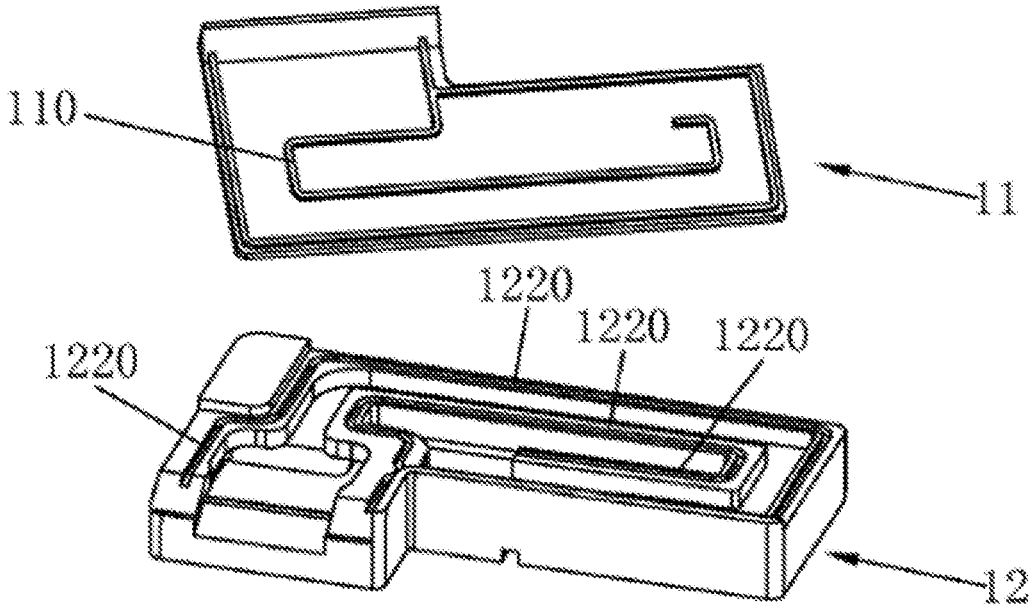
FIG. 6 is a three-dimensional structure exploded view of the upper housing and middle housing of the loudspeaker module according to the present invention.

As shown in FIG. 1 and FIG. 6 jointly, the upper housing 11 is provided with a sealing rib 110, which protrudes from the lower surface of the upper housing 11, at a position facing the inner lateral wall 122; the inner lateral wall 122 of the middle housing 12 is provided with a concave accommodating groove 1220, which is formed by removing material, at a position corresponding to the sealing rib 110, wherein, the accommodating groove 1220 has a radial width slightly larger than that of the sealing rib 110. The sealing rib 110 is snap-fitted into the accommodating groove 1220 and sealed by gluing, so that the inner lateral wall 122 and the upper housing 11 are hermetically combined in order to prevent the inverted tube from leakage and ensure the airtightness of the inverted tube. It should be noted that the way of hermetical combination between the upper housing 11 and the inner lateral wall 122 is not limited thereto, the sealing rib 110 may be a welded rib, and the welded rib on the upper housing 11 is fixedly combined with the inner lateral wall 122 by ultrasonic welding. The edge of the upper housing 11 and the outer lateral wall 123 of the middle housing 12 may be hermetically fixed by gluing or ultrasonic welding, and in present embodiment, sealing is achieved by gluing.

The inverted tube is formed by the middle housing 12 and the upper housing 11 jointly. Preferably, the inverted tube is surrounded by the inner lateral wall 122, partition wall 124, and outer lateral wall 123 of the middle housing 12 as well as the upper housing 11. Preferably, the inverted tube of the present invention is formed by fixedly combining the sealing rib 110 of the upper housing 11 with the inner lateral wall 122 of the middle housing 12, and combining the edge of the upper housing 11 with the outer lateral wall 123 of the middle housing 12, i.e., the inverted tube of the present invention is formed by the inner lateral wall 122 of the middle housing 12, the partition wall 124 of the middle housing 12 and the top wall 110 of the upper housing 11 jointly. Likewise, the inverted tube may have other modified structures, for example, when the height of the sealing rib 110 is larger than the depth of the accommodating groove 1220, the inverted tube further comprises a portion of the sealing rib located between the top wall of the upper housing 11 and the inner lateral wall 122.

Figure 5:
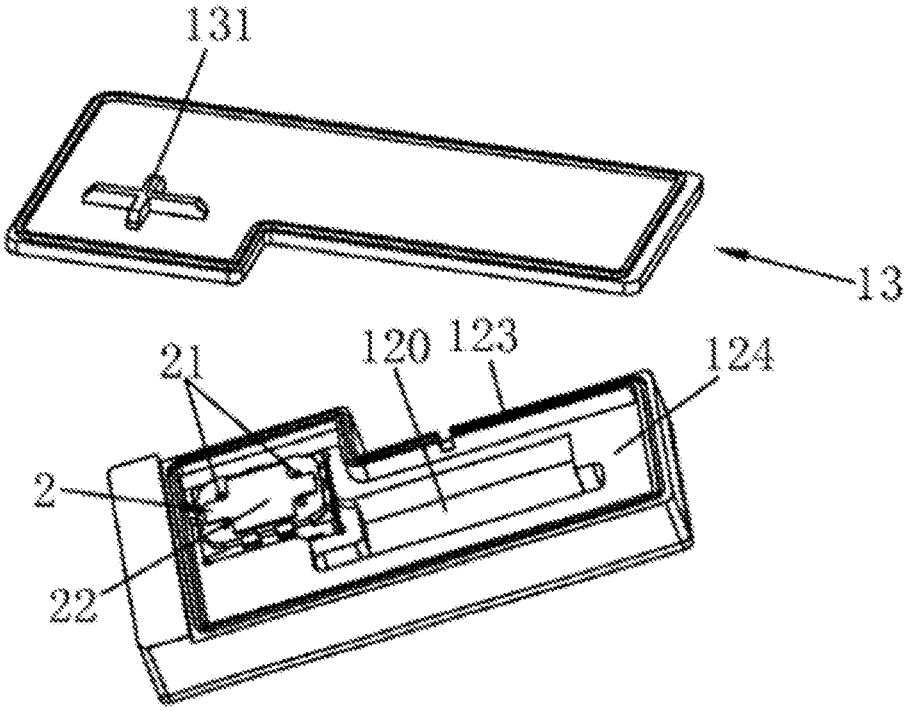
FIG. 5 is a three-dimensional structure view showing the lower housing, and the middle housing assembled with the loudspeaker unit according to the present invention.

As shown in FIG. 4 and FIG. 5 jointly, the loudspeaker unit 2 has a rectangular shape, four corners of the rectangular loudspeaker unit 2 are provided with sound outlet holes 21, the lower housing 13 is provided with a supporting part 131 at a position facing center of the loudspeaker unit 2, and the supporting part has a cruciform shape, so as to prevent the sound outlet holes 21 of the loudspeaker unit 2 from being blocked, and moreover, the supporting part having cruciform shape can support the loudspeaker unit 2 steadily. In addition, a piece of foam 22 is provided at a side of the loudspeaker unit 2 facing the lower housing 13, and the foam 22 functions as cushion to prevent the loudspeaker unit 2 from being damaged in cases of falling down, etc. Wherein, the rear acoustic cavity is formed by the loudspeaker unit 2, the partition wall 124, the outer lateral wall 123 and the bottom wall of the lower housing 13 jointly. The acoustic waves radiated by the vibrating diaphragm of the loudspeaker unit 2 at rear side thereof are transmitted into the rear acoustic cavity through the sound outlet holes 21, and then transmitted into the inverted tube through the open end 120.

Figure 2:
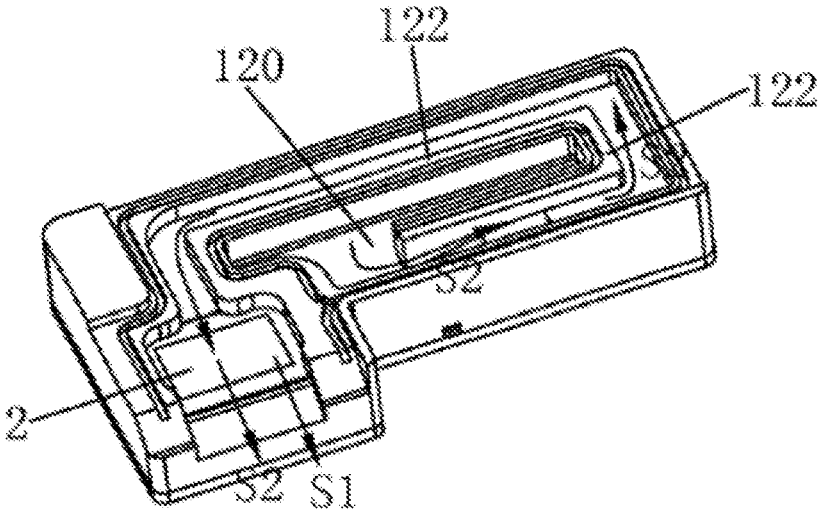
FIG. 2 is a three-dimensional structure view of the loudspeaker unit combined with the middle housing according to the present invention.
Figure 3:
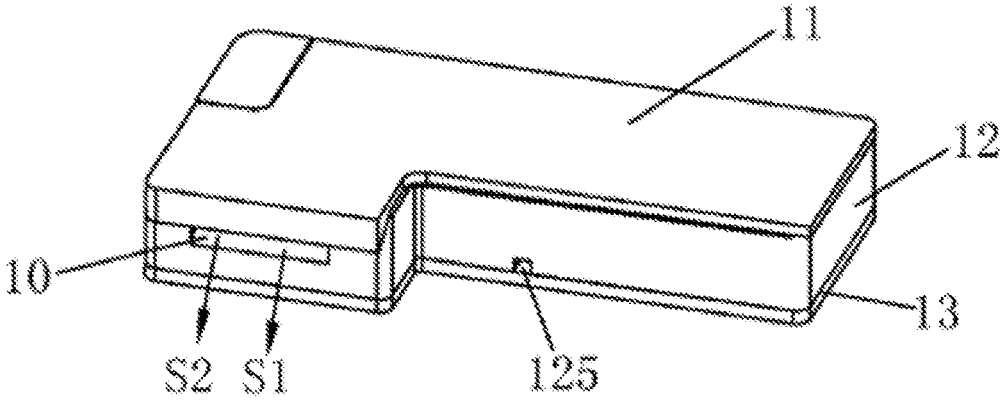
FIG. 3 is a three-dimensional assembled structure view of the loudspeaker module according to the present invention.

The sound hole 10 of the loudspeaker module of the present embodiment is arranged in the lateral surface, as shown in FIG. 3, but is not limited thereto, the sound hole may be arranged at a side facing the loudspeaker unit 2, and the loudspeaker unit 2 is fixedly combined with the fixing part 121 of the middle housing 12. The front acoustic cavity of the loudspeaker module is surrounded by the inner lateral wall 122 and the outer lateral wall 123 at two sides of the loudspeaker unit 2, as well as the loudspeaker unit 2 and the upper housing 11 jointly, wherein, the front acoustic cavity of the loudspeaker module is in communication with the sound hole 10. The acoustic waves generated at the front side of the vibrating diaphragm of the loudspeaker unit 2 are radiated into the front acoustic cavity, and then radiated to outside through the sound hole 10, i.e., acoustic waves generated by the vibrating diaphragm of the loudspeaker unit 2 to the front acoustic cavity are radiated to outside through path S1, as shown in FIG. 2 and FIG. 3. As shown in FIG. 2, the inverted tube formed between the inner lateral wall 122 and the outer lateral wall 123 of the middle housing 12 is provided with another open end of the inverted tube at the edge of the loudspeaker unit 2, and the open end is in communication with the front sound cavity of the loudspeaker module. The acoustic waves in the rear acoustic cavity of the loudspeaker module enter into the inverted tube through the open end 120, and enter into the front acoustic cavity through the open end of the inverted tube at one side of the front acoustic cavity after passing through the inverted tube, and then radiated to outside after passing through the front sound cavity, i.e., acoustic waves generated at the rear side of the vibrating diaphragm are radiated to outside through path S2, as shown in FIG. 2 and FIG. 3, i.e., acoustic waves in the front sound cavity of the present invention is radiated to outside through the sound hole 10 after passing through path S1, and the acoustic waves in the inverted tube are radiated to outside through the sound hole 10 after passing through path S2, and the inverted tube shares the front sound cavity and the sound hole 10. With such a structure, in case of the position and size of the sound hole of the loudspeaker module are fixed, there is no need for dividing the sound hole 10 into two mutually separated parts due to the inverted tube shares the sound hole, which is beneficial to increasing the inner diameter of the sound hole 10. In addition, with the inverted tube sharing the front sound cavity, there is no need for providing a structure, which is in communication with the sound hole 10, in the loudspeaker module, thereby increasing the installation space of the loudspeaker module, which is beneficial to increasing the size of the loudspeaker unit 2.

In addition, the loudspeaker module of the present invention is electrically connected to terminal electronic devices by a cable which is not illustrated in the accompanying drawings of the present invention, and an opening 125 for leading out the cable is provided at the lower side of the middle housing 12, as shown in FIG. 3. A leaking hole for communicating the rear acoustic cavity and outside is not provided on the peripheral frame of the loudspeaker module according to the present invention. The front sound cavity of the present embodiment is a cavity formed by fixedly combining the upper housing 11, the middle housing 12 and the loudspeaker unit 2; and the rear acoustic cavity is a cavity formed by fixedly combining the middle housing 12, the lower housing 13 and the loudspeaker unit 2, wherein the accompanying drawings of the present invention only illustrate the internal structure of the loudspeaker module.

The loudspeaker module of the present invention is provided with an inverted tube in communication with the rear acoustic cavity, and the inverted tube is in communication with outside. As the pore size of the inverted tube is larger than that of conventional leaking hole, the loudspeaker module of the present invention has better heat dissipation capability, which ensures the useful life of the product, and the inverted tube being in communication with outside can equilibrate sound pressure. Thus, there is no need for providing a leaking hole, which is used for communicating the rear acoustic cavity and outside, on the lower housing 13 or the middle housing 12 if the inverted tube is provided. The structure with the inverted tube provided in the loudspeaker module can extend the low frequency of the product effectively, and improve the bass effect of the product. In addition, in case of the position and size of the sound hole 10 are fixed, the structure with the inverted tube sharing the front sound cavity and the sound hole 10 can increase the inner diameter of the sound hole, which is beneficial to effective radiation of acoustic waves, and can increase the size of the loudspeaker unit, which is beneficial to improving the acoustic performance of the product.

With the above structure of the present invention, the bass effect of specific low frequency band can be enhanced remarkably, and Fb may be adjusted by adjusting the volume of the rear cavity and the size of the inverted tube, wherein, Fb is the resonant frequency of the rear acoustic cavity and the inverted tube. The bass effect of specific low frequency band may be adjusted by adjusting the relationship between Fb and F0, so as to enhance the specific low frequency band, wherein, Fb and F0 satisfy the following relations: the ratio of Fb to F0 ranges from ⅓ to 1.4, and wherein, F0 is the resonant frequency of the loudspeaker unit.

With the above teaching of the present invention, other improvements and variants can be made by those skilled in the art based on the above embodiments, and the improvements and variants should be considered as encompassed within the scope of the present invention. It will be understood by those skilled in the art that the above specific description aims at better understanding of the present invention, and the scope of the present invention is limited by the claims and its equivalents.

What is claimed is:

1. A loudspeaker module, comprising a loudspeaker unit (2) and a peripheral frame accommodating and fixing the loudspeaker unit (2), wherein, the peripheral frame comprises an upper housing (11) and a lower housing (13), a front acoustic cavity is defined as a space between the loudspeaker unit (2) and the upper housing (11), and a rear acoustic cavity is defined as a space between the loudspeaker unit (2) and the lower housing (13); a sound hole (10) in communication with the front acoustic cavity is provided on the peripheral frame, wherein, acoustic waves radiated by a vibrating diaphragm of the loudspeaker unit (2) to the front acoustic cavity are radiated to outside through the front acoustic cavity and the sound hole (10); and an inverted tube is further provided in the peripheral frame, wherein, one end of the inverted tube is in communication with the rear acoustic cavity, other end of the inverted tube is in communication with the front acoustic cavity, and acoustic waves radiated by the vibrating diaphragm of the loudspeaker unit (2) to the rear acoustic cavity are radiated to the outside from the sound hole (10) after passing through the inverted tube and the front acoustic cavity, wherein the peripheral frame further comprises a middle housing (12) combined between the upper housing (11) and the lower housing (13);

the middle housing (12) comprises an outer lateral wall (123) combined with the upper housing (11) and the lower housing (13), an inner lateral wall (122) provided in the middle housing (12), and a partition wall (124) provided at bottom of the inner lateral wall (122); the inner lateral wall (122) together with the outer lateral wall (123) forms a channel for transmitting acoustic waves; one end of the channel is in communication with the rear acoustic cavity, and other end of the channel extends to the front acoustic cavity; and the inner lateral wall (122), the partition wall (124), and the outer lateral wall (123) of the middle housing (12) together with the upper housing (11) form the inverted tube.

2. The loudspeaker module according to claim 1, wherein, the upper housing (11) is provided with a sealing rib (110), which protrudes from a lower surface of the upper housing (11), at a position facing the inner lateral wall (122) of the middle housing (12); and a top end of the inner lateral wall (122) of the middle housing (12) is provided with a accommodating groove (1220), which is formed by removing material, at a position facing the sealing rib (110), wherein, the sealing rib (110) is snap-fitted into the accommodating groove (1220), and the sealing rib (110) is fixedly combined with the accommodating groove (1220) by gluing.

3. The loudspeaker module according to claim 2, wherein, the sealing rib (110) is a welded rib, and the sealing rib (110) is fixedly combined with the inner lateral wall (122) of the middle housing (12) by welding.

4. The loudspeaker module according to claim 1, wherein, the loudspeaker unit (2) has a rectangular shape, four corners of bottom of the loudspeaker unit (2) are provided with sound outlet holes (21), the lower housing (13) is provided with a supporting part (131) at a position opposite to a center of the bottom of the loudspeaker unit (2), and the supporting part (131) has a cruciform shape, so as to prevent the sound outlet holes (21) at the bottom of the loudspeaker unit (2) from being blocked by the lower housing (13).

5. The loudspeaker module according to claim 4, wherein, the loudspeaker unit (2) together with the partition wall (124) of the middle housing (12), the outer lateral wall (123) of the middle housing (12) and the lower housing (13) forms the rear acoustic cavity;

an open end (120) penetrating through the middle housing (12) is provided at a central position of the inner lateral wall (122), wherein, the open end (120) is an opening for communicating the inverted tube with the rear acoustic cavity, so that the acoustic waves in the rear acoustic cavity enter into the inverted tube through the open end (120).

6. The loudspeaker module according to claim 1, wherein, the middle housing (12) comprises a fixing part (121) for accommodating and fixing the loudspeaker unit (2); and the loudspeaker unit (2) together with the upper housing (11) and the middle housing (12) forms the front acoustic cavity of the loudspeaker module.

7. The loudspeaker module according to claim 1, wherein, a ratio of a resonant frequency of the rear acoustic cavity and the inverted tube to that of the loudspeaker unit (2) ranges from ⅓ to 1.4.

* * * * *